US005453031A

United States Patent [19]

Gagnier

[11] Patent Number: 5,453,031

[45] Date of Patent: Sep. 26, 1995

[54] HAND PROPULSION DEVICE FOR A PADDLE BOAT

[76] Inventor: David L. Gagnier, 4930 Ottawa Ct., Owosso, Mich. 48867

[21] Appl. No.: 277,334

[22] Filed: Jul. 19, 1994

[51] Int. Cl.[6] ..... B63H 16/20

[52] U.S. Cl. ..... 440/26; 440/90

[58] Field of Search ..... 440/21–32, 90

[56] References Cited

U.S. PATENT DOCUMENTS 470,108 3/1892 Dick ..... 440/30

2,319,132 5/1943 Hood ..... 440/31

4,668,196 5/1987 Billmayer et al. ..... 440/27

*Primary Examiner*—Jesus D. Sotelo

*Attorney, Agent, or Firm*—Weintraub, DuRoss & Brady

[57] ABSTRACT

A hand propulsion device for a paddle wheel boat has a cranking mechanism of handles turning a sprocket. The sprocket drives a chain, which is mounted between the first sprocket and a second sprocket. The chain, in part, turns the second sprocket, which turns an axle and then, in turn, turns the paddle wheel. The device allows handicapped person, who cannot drive the boat with foot power, to operate a paddleboat and enjoy water recreation.

11 Claims, 2 Drawing Sheets

FIG 1
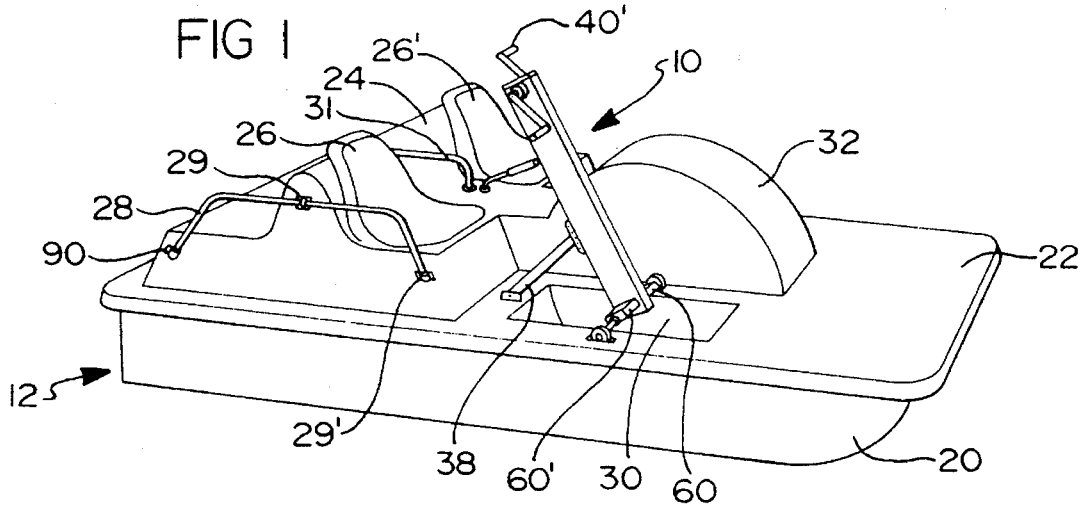
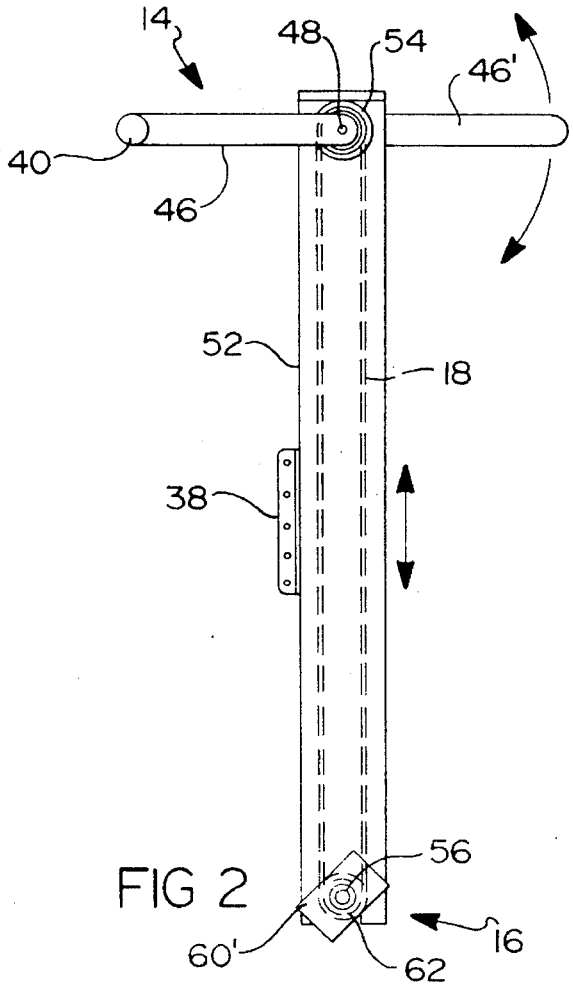
FIG 2

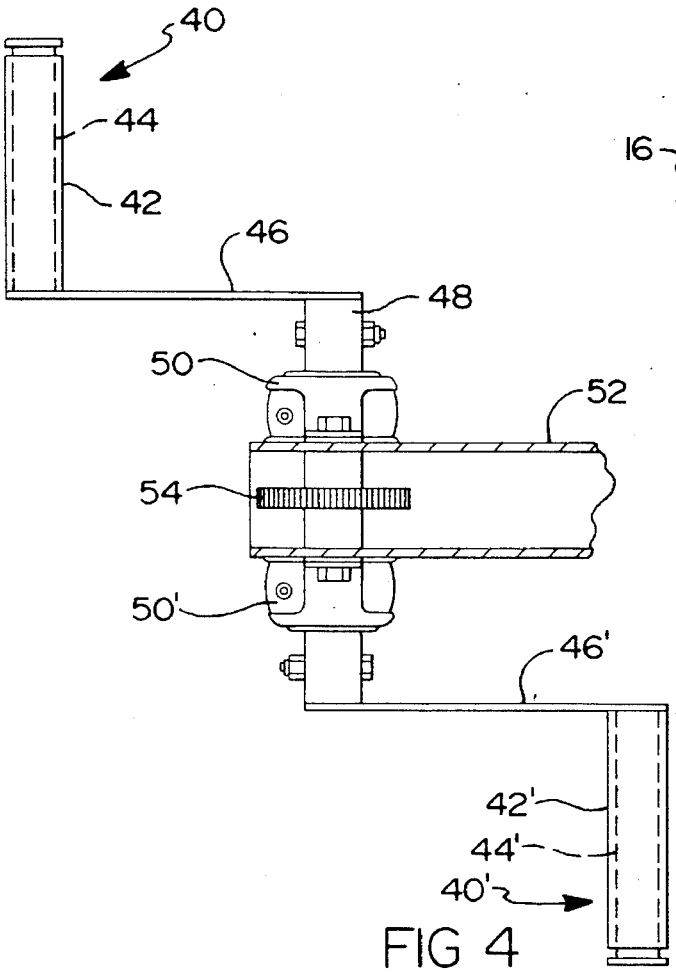
FIG 4
FIG 3
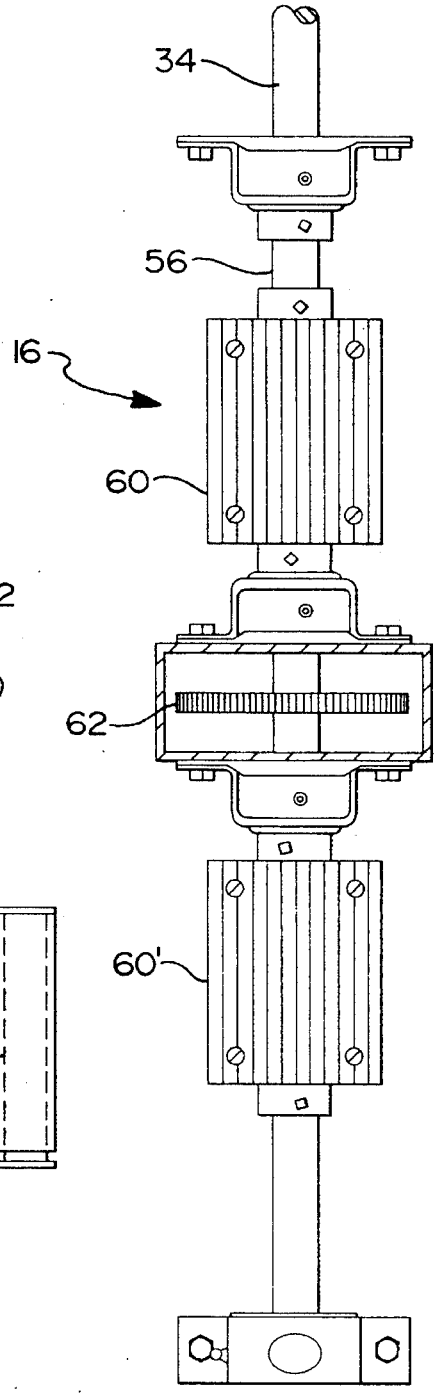

HAND PROPULSION DEVICE FOR A PADDLE BOAT

FIELD OF THE INVENTION

The present invention pertains to paddle boats. More particularly, the present invention concerns means for propelling the paddle boat usable by physically handicapped individuals.

DESCRIPTION OF THE ART:

Paddle boats, in varying designs, have existed for a number of years. Commonly, the paddle boat comprises a hull formed of plastic, fiberglass, or other durable, yet lightweight material. Proximate the stern of the boat are formed at least two seats for the riders to sit upon. A feet well is formed in the hull forwardly of each seat. Between each feet well, proximate the bow of the boat, is formed a wheel housing. A paddle wheel is set therein upon an axle. Connected to each end of the axle is a set of peddles. The peddles are deployed within a feet well. The riders can propel the boat by working the peddles with their feet. This imparts rotational force to the paddle wheel, which drives into and through the water. The boat is directed by a handle which positions the rudder of the boat, which either rider may direct with one of his or her free arms.

This basic design offers those with sufficient leg strength a means for enjoying a leisurely ride upon a body of water. For those physically handicapped, either with reduced leg strength or paralysis, this boat does not allow for enjoyment on the water or exercise in propelling the boat. It is to the goal of making such water craft accessible to physically challenged individuals that the present invention is directed.

SUMMARY OF THE INVENTION

The present invention is a hand propulsion mechanism for use with a paddle boat, the paddle boat having a paddle wheel deployed upon a main axle. The propulsion mechanism comprises:

(a) means for cranking; and (b) means for driving the paddle wheel;

wherein the means for cranking is suitably connected to the means for driving so that the force is achieved in the means for cranking is translated to the means for driving.

The propulsion device of the present invention may further comprise a housing, wherein the means for cranking is mounted to the housing. The housing, in turn, is attached to the means for driving.

In a preferred embodiment, the means for cranking may comprise:

(a) a first axle rotationally deployed through the housing;

(b) a first sprocket coaxially mounted upon the first axle; and (c) means for grasping, the means for grasping being connected to the first axle.

Further, the means for grasping may comprise:

(1) a plurality of cylindrical members; and (2) a corresponding plurality of flat members, each flat member being connected to one associated cylindrical member.

Also in the preferred embodiment, the means for driving may comprise:

(a) a second axle being connected to the main axle;

(b) a second sprocket coaxially mounted upon the second axle; and (c) a drive chain, the drive chain being connected at one end to the first sprocket and at a second end to the second sprocket.

The present invention may alternately comprise, in combination, a paddleboat and a hand propulsion device, wherein:

(a) the paddleboat comprises:
  (1) a hull;
  (2) a platform mounted upon the hull;
  (3) a seating member deployed upon the hull;
  (4) a main axle rotatively mounted on the hull; and
  (5) a paddlewheel axial mounted upon the main axle; and (b) the hand propulsion device comprising:
  (1) a housing mounted to the main axle;
  (2) a first axle deployed rotatively on the housing;
  (3) a first sprocket deployed upon the first axle;
  (4) means for cranking deployed with the first axle;
  (5) a second sprocket deployed concentrically upon the main axle; and
  (6) a chain interdigitively deployed around the first sprocket and the second sprocket;

wherein the rotation of the means for cranking effects the rotation of the first axle and the first sprocket, the first sprocket driving the chain and, in turn, rotating the second sprocket, the driving of the second sprocket effecting the rotation of the main axle, turning the paddlewheel and propelling the paddleboat.

The present invention will be more clearly understood with reference to the accompanying drawings, in which like reference numerals refer to like parts, in which:

BRIEF DESCRIPTION OF THE DRAWINGS

FIG. 1 is a perspective view of the hand-propulsion mechanism of the present invention deployed upon a paddle boat;

FIG. 2 is a side view of the hand-propulsion mechanism of the present invention;

FIG. 3 is a cross-sectional view of the first axle and the first sprocket of the hand-propulsion mechanism of the present invention; and FIG. 4 is a cross-sectional view of the second sprocket and the second axle of the hand-propulsion mechanism of the present invention.

DETAILED DESCRIPTION OF THE PREFERRED EMBODIMENT

Referring now to FIG. 1–4, there is shown therein the present invention, to wit, a hand-powered propulsion device 10 for use with a paddle boat 12. The propulsion device 10 comprises means 14 for cranking, means 16 for driving the paddleboat 12 and a drive chain 18 deployed in connection with and between the means 14 for cranking and the means 16 for driving the paddleboat 12.

Before entering a fuller description of the hand propulsion device 10, a prefatory discussion of the paddle boat 12 is warranted. The paddle boat 12, with which the present invention is utilized, is formed typically of fiberglass, plastic or an otherwise lightweight, yet sturdy material. The paddle boat 12 comprises a hull 20 and a platform 22, the platform 22 being mounted atop the hull 20. A seating member 24 is deployed upon the platform 22 proximate the stern of the paddleboat 12. The seating member 24 has, as shown in FIG. 1, a pair of seats 26, 26' formed thereon. The seating member 24 is envisioned having at least two seats and can include more than two, particularly four.

In so much as the present invention is a device directed toward helping handicapped individuals enjoy water recreation, the paddle boat 12 will be understood to have features especially provided for their needs. A side rail 28 is mounted on a hinge 90, proximate the seating member 24. A pair of pin connectors 29, 29' are mounted upon the seating member 24. The pin connectors 29, 29' receive and hold the rail 28 therein. The rail 28 may be released from the connectors 29, 29' to allow the rail 28 to be swung away from the seating member 24. The hinged rail 28 allows greater ease of access for the user to the seating member 26 and particularly the seat 26.

A second rail 31 is additionally deployed between the seats 26, 26' on the seating member 24. The second rail 31 allows a person seated on the seating member 26 to steady his or her balance or to otherwise shift around.

Forward of the seats 26, 26' are formed in the platform 22 a pair of feet wells 30. The paddleboat 12 has a paddle wheel (not shown) deployed between the feet wells 30. The wheel is deployed in a wheel housing 32. A main axle 34 extends outwardly from the wheel housing 32 and is deployed in the feet wells 30. For a non-handicapped rider, the axle 34 has a pair of foot pedals deployed on an S-shaped shaft (not shown) as is commonly known. The feet of the non-handicapped rider then turn the S-shaft by the force exerted by the legs of the user. As the riders travel upon the paddleboat 12, a handle 36 is positioned to correspondingly adjust the angularization of a rudder (not shown). This allows the riders to direct the paddleboat 12 by positioning a rudder (not shown), as is well known.

Referring again to the present invention, it can be seen that the propulsion device 10 is deployed above the feet well 30. The device 10 is secured above the well 30 by a bar 38. The bar 38 is affixed at one end to the device 10 and at the second end to the platform 22.

As seen in FIG. 1 and 4, the means 14 for cranking comprises a pair of grips 40, 40'. The grips 40, 40' comprise a sleeve 42, 42' deployed circumferentially around a cylindrical member 44, 44'. The grips 40, 40' are attached substantially normal to corresponding flat members 46, 46'. The flat members 46, 46' are substantially normal to a cranking axle 48. A pair of sustaining members 50, 50' fit circumferentially around the axle 48 and attach to a housing 52. The sustaining members 50, 50' keep the axle 48 level, such that it may be rotated by the turning of the grips 40, 40'.

A first sprocket 54 is deployed upon the axle 48. The first sprocket 54 is a generally circular gear, having a plurality of teeth deployed around the circumference thereof, as is known. The first sprocket 54 serves to drive a chain 18, as will be set forth herein below. Thus, the first sprocket 54 is a drive sprocket.

in operation, the grips 40, 40' are grasped by the user and rotated about the axle 48. This rotational activity effects a turning of the axle 48. As the axle 48 rotates, the first sprocket 54 is rotated. By this series of interrelated mechanical actions, the means 14 for cranking translates the cranking action of the grips 40, 40' into a force which may be applied to the means 16 for driving, as detailed herein below.

A chain 18 is deployed around the first sprocket 54. The chain 18 is formed of a plurality of links joined together, as is known. The chain 18 is preferably a roller chain comprising alternating roller links and pin links joined by a bushing. The chain 18 alternately could be a pintle chain, comprising a plurality of identical links joined by a pintle. Other chains could be elected such as a belt having apertures formed therein, where feasible.

The chain 18 is deployed over the first sprocket 54 such that one tooth of the sprocket 54 fits into one link of the chain 18. Thus, a plurality of teeth fit into a plurality of links. This interdigitation facilitates the movement of the chain 18, as will be further discussed herein below.

Referring now to FIG. 4, the means 16 for driving can be seen as comprising a second axle 56 deployed over the feet well 30. The second axle 56 is joined to a main axle 34, the paddle wheel (not shown) being mounted upon the main axle 34. Upon the second axle 56 are mounted a pair of foot pedals 60, 60'. The foot pedals 60, 60' are coaxially mounted upon the axle 56 such that the rotation of the second axle 56 does not affect the position of the foot pedals 60, 60'. That is to say, the pedals 60, 60' do not rotate with the turning of the second axle 56.

As can be best seen in FIG. 1, the housing 52 is deployed such that the second axle 56 passes therethrough. By the deployment of the bar 38, there is a stationary positioning of the housing 52 relative to the seating member 26. This facilitates the usage of the means 14 for cranking and also allows the rotation of the second axle 56.

Within the housing 52 there is deployed upon the second axle 56 a second sprocket 62. The second sprocket 62 is a circular gear having a plurality of teeth deployed around the circumference thereof, similarly to the first sprocket 54. The second sprocket 62 is fixedly mounted to the second axle 56 such that rotation of the second sprocket 62 effects the rotation of the second axle 56. The chain 18 is deployed around the teeth of the second sprocket 62 similarly to the first sprocket 54. The second sprocket 62 thus acts as a driver sprocket, since it receives the force of the chain 18.

The operation of the propulsion device 10 will now be set forth. With reference to FIG. 2, it is seen that the grips 40, 40' are rotated. This effects rotation of the first axle 48 and the first or driver sprocket 54. By the rotation of the first sprocket 54, due to its interdigitation with the chain 18, the chain 18 is driven and the second or driver sprocket 62 is turned. This rotation of the second sprocket 62 effects rotation of the second axle 56. The second axle 56 then transmits the rotational force received from the chain 18 and means 14 for cranking to the main axle 34. This, in turn, rotates the paddle wheel, propelling the boat 12.

It is to be noted that the means 14 for cranking may be modified, such that the first sprocket 54 may be replaced with a gear having different engagement means deployed around the perimeter thereof. These different engagement means will allow interaction with chains differing from the known roller or pintle chains. Such different chains could be flat members having holes formed therein. Alternately, the gear could be replaced with a grooved member, such that a belt could be deployed therein. Of course, any such change in the means 14 for cranking would require like replacement of the second sprocket 62 of the means 16 for driving.

Having thus described the invention, what is claimed is:

1. A hand propulsion device for deployment upon a paddle boat having a paddle wheel deployed upon a main axle, the device comprising:

(a) means for driving the paddle wheel;

(b) means for cranking being connected to the means for driving; and (c) a housing, the means for cranking being mounted to the housing, the housing being attached to the means for driving.

2. The propulsion device of claim 1, the means for cranking comprising:

(a) a first axle deployed through the housing;

(b) a first sprocket mounted upon the first axle, the first sprocket being deployed within the housing; and (c) means for rotating the first axle.

3. The propulsion device of claim 2, the means for rotating comprising:

(a) a plurality of cylindrical members; and (b) a plurality of flat members, each flat member being connected to one cylindrical member, each flat member being connected to the first axle.

4. The propulsion device of claim 3, the device further comprising:

a plurality of sleeves, one sleeve being deployed upon one cylindrical member.

5. The propulsion device of claim 2, the means for driving comprising:

(a) a second axle, the second axle being connected to the main axle; the housing being mounted upon the second axle;

(b) a second sprocket mounted upon the second axle, the second sprocket being deployed within the housing; and (c) a chain interdigitively deployed around the first sprocket and the second sprocket, the chain being deployed within the housing.

6. The propulsion device of claim 5, the device further comprising:

a pair of foot pedals deployed coaxially around the second axle.

7. The propulsion device of claim 5, wherein the chain comprises a belt having apertures formed wherein.

8. A hand propulsion device for deployment upon a paddle boat, the paddle boat having a paddle wheel deployed upon a main axle, the hand propulsion device comprising:

(a) a first axle;

(b) a plurality of grips;

(c) a plurality of flat members, the number of flat members corresponding to the number of grips, each flat member being attached substantially normal with one corresponding grip, and further attached substantially normal to the first axle;

(d) a housing, the first axle being deployed through the housing proximate one end thereof;

(e) a first sprocket deployed upon the first axle, the first sprocket being deployed within the housing;

(f) a second axle, the second axle being deployed through the housing, the second axle being connected to the main axle;

(g) a second sprocket mounted upon the second axle, the second sprocket being disposed within the housing;

(h) a chain comprising a plurality of interlocked links forming a loop, the chain being deployed interdigitatively upon the first sprocket and the second sprocket; and (i) a pair of foot pedals coaxially mounted upon the second axle;

wherein the rotation of the grips rotate the first axle and the first sprocket, the rotation of the first sprocket driving the chain and thereby causing the rotation of the second sprocket, the rotation of the second sprocket turning the second axle and thereby the main axle and mounted paddle wheel.

9. The propulsion device of claim 8, the device further comprising:

a bar attached at a first end to the housing and attached at a second end to the boat, the bar serving to stabilize the position of the device.

10. In combination, a paddleboat and a hand propulsion device wherein:

(a) the paddleboat comprises:

(1) a hull;.

(2) a platform mounted upon the hull;

(3) a seating member deployed upon the platform;

(4) main axle rotatively mounted on the hull;

(5) a paddle wheel axially mounted upon the main axle; and (6) at least one bar hingedly affixed to the seating member;

(b) the hand propulsion device comprising:

(1) a housing mounted to the main axle;

(2) a first axle deployed rotatively on the housing;

(3) a first sprocket deployed upon the first axle;

(4) means for cranking deployed with the first axle;

(5) a second sprocket deployed concentrically upon the main axle; and;

(6) a chain interdigitatively deployed around the first sprocket and the second sprocket;

wherein the rotation of the means for cranking effects the rotation of the first axle and the first sprocket, the first sprocket driving the chain and in turn rotating the second sprocket, the driving of the second sprocket effecting rotation of the main axle, turning the paddle wheel and propelling the paddle boat.

11. The combination of claim 10, wherein the paddleboat further comprises at least one footwell formed in the platform.

* * * * *